United States Patent [19]

Hanyu et al.

[11] Patent Number: 4,736,697

[45] Date of Patent: Apr. 12, 1988

[54] FABRIC PRESSER DEVICE OF A SEWING MACHINE

[75] Inventors: Susumu Hanyu; Kouzi Okutani, both of Tokyo; Tamotsu Nakagawa, Hachioji, all of Japan

[73] Assignee: Janome Sewing Machine Co., Ltd., Tokyo, Japan

[21] Appl. No.: 837,860

[22] Filed: Mar. 5, 1986

Related U.S. Application Data

[63] Continuation of Ser. No. 625,116, Jun. 27, 1984, abandoned.

[30] Foreign Application Priority Data

Jul. 6, 1984 [JP] Japan ..... 59-121598

[51] Int. Cl.[4] ..... D05B 29/12; D05B 69/36

[52] U.S. Cl. ..... 112/240; 112/277

[58] Field of Search ..... 112/235, 236, 240, 277

[56] References Cited

U.S. PATENT DOCUMENTS

| | | | |
|---|---|---|---|
| 2,545,980 | 3/1951 | Vanadia et al. | 112/235 |
| 3,005,429 | 10/1961 | Weschler | 112/235 |
| 3,854,433 | 12/1974 | Hanyu | 112/240 X |
| 3,858,538 | 1/1975 | Van Amburg | 112/235 |
| 4,248,167 | 2/1981 | Reinert | 112/277 X |
| 4,372,231 | 2/1983 | Odermann et al. | 112/277 X |
| 4,416,208 | 11/1983 | Nufer | 112/240 |

FOREIGN PATENT DOCUMENTS

| | | | |
|---|---|---|---|
| 59-22594 | 2/1984 | Japan | 112/235 |

*Primary Examiner*—Wm. Carter Reynolds

*Attorney, Agent, or Firm*—Michael J. Striker

[57] ABSTRACT

A devised shank is provided to a presser foot of a sewing machine in addition to an ordinary shank, such that a special presser group for straight stitching along a fabric edge is attached to the devised shank only, in which the presser foot is attachable to a presser holder, and the ordinary shank is for such as zigzag stitching, and the devised shank is different in an attaching width from the ordinary shank. Signal generating parts are provided to the presser holder, which each issue a signal in response to when the presser foot is attached, and the signal is discriminated with a signal issued in response to a pattern group belonging to patterns selected by a pattern selecting means so that the sewing machine is driven only when the presser group and the pattern group is met.

3 Claims, 3 Drawing Sheets

Prior Art

FABRIC PRESSER DEVICE OF A SEWING MACHINE

This application is a continuation of application Ser. No. 625,116, filed June 17, 1984, now abandoned.

BACKGROUND OF THE INVENTION

Field of the Invention

The invention relates to a fabric presser device of a sewing machine, a presser holder of which is devised with a special shank to prevent erroneous use of presser feet.

When a fabric is stitched at its edge with straight stitching or hem-stitching by a sewing machine, a needle is set at a left basic line in view of operating efficiency. FIGS. 1, 2 and 1A show a conventional fabric presser device.

As is shown in FIGS. 1 and 2, a center line of a shank 1*a* for attaching a presser bottom plate 3 of a presser holder 1 and a position actually pressing the fabric slide in a transversal direction with a feed dog, and there arise problems that the bottom plate 3 is oblique with respect to a horizontal line, the fabric 2 escapes in a left side of the drawing, or a stitching line is unstable and gets out from the presser bottom plate 3. As shown in FIG. 1A a presser holder 1 having the single shank 1*a* is secured to a presser bar B by a thumb screw C.

SUMMARY OF THE INVENTION

An object of the invention is to provide an additional shank to a presser foot of a sewing machine in addition to a customary shank. This and other objects of the invention are attained by a fabric presser device in which a special presser group for straight stitching along a fabric edge is attached to the additional shank only, and the presser foot is such that a presser bottom plate is detachably attached to a presser holder to be attached to a presser bar, and the ordinary shank is provided to the presser holder for an ordinary presser group such as zigzag stitching. The additional shank is different in an attaching width from said ordinary shank, whereby erroneous use of the presser foot is avoided and an applied range of stitching may be enlarged. Signal generating parts are provided to the presser holder, which each issue a signal in response to the presser holder when the presser foot being attached, said signal is compared and discriminated with a signal which is issued in response to a pattern group belonging to patterns selected by a pattern selecting means so that the sewing machine is not driven when the presser group and the pattern group are not met, whereby to an erroneous operation is avoided.

The attached drawings illustrate the most preferable embodiments of the invention.

BRIEF DESCRIPTION OF THE DRAWINGS

In the drawings, FIGS. 3 to 5 illustrate a first embodiment of the invention, and FIGS. 6 to 8 show a second embodiment thereof.

DETAILED DESCRIPTION OF THE PREFERRED EMBODIMENTS OF THE INVENTION

Figure 1:
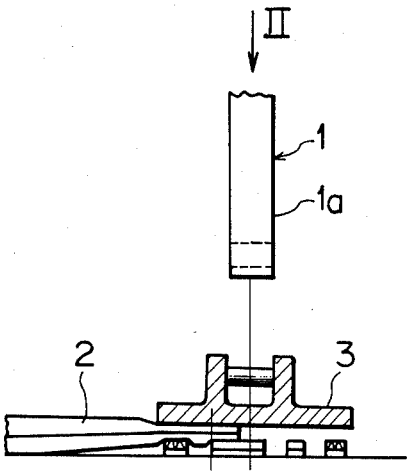
FIGS. 1 and 1A are cross sectional views of conventional devices, showing a relative position in a transversal direction with a feed dog between a presser foot and a fabric during stitching operation.
Figure 3:
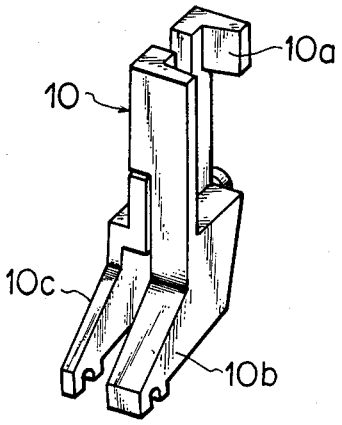
Prior Art FIG 3
FIG. 3 is a perspective view of a presser holder.
Figure 2:
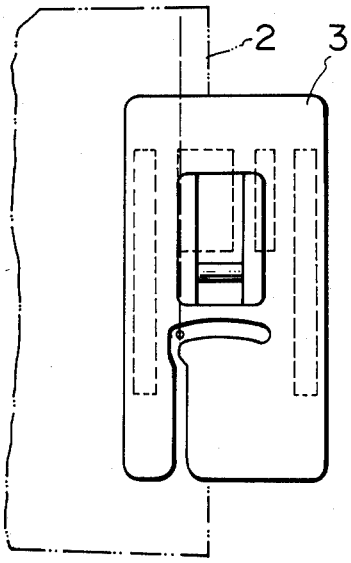
FIG. 2 is a view seen from an arrow II in FIG. 1.
Figure 4:
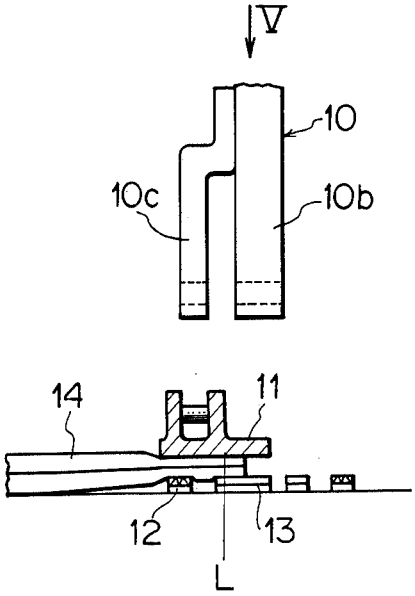
Prior Art FIG 4
FIG. 4 is a cross sectional view showing a relative position in a transversal direction with a feed dog between a presser foot and a fabric during stitching operation.
Figure 1A:
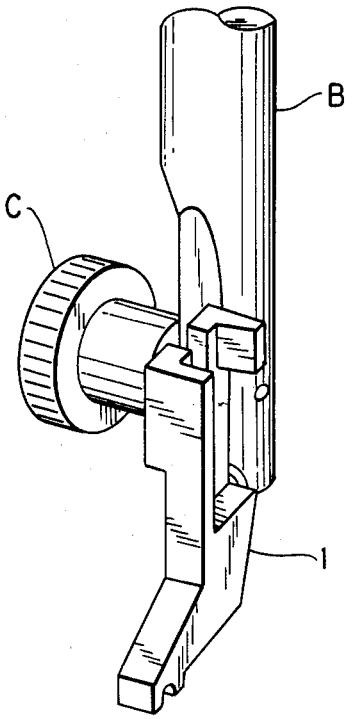
Figure 5:
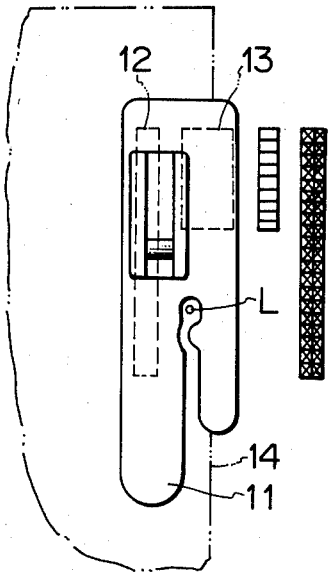
FIG 5 is a view seen from an arrow V in FIG. 4.

The invention will be explained with reference to the first embodiment. In FIG. 3, a presser holder 10 is formed with an attaching part 10*a* to a presser bar, and is provided at its lower part with a shank 10*b* and another shank 10*c* which is different from said shank 10*b* in an attaching width of a presser foot. In the present embodiment the pressers are classified into two groups of a special presser group and an ordinary presser group in accordance with stitching operations, where the former is for pressing the fabric edge, and the latter is for ordinary presser of such as zigzag stitching.

The shank 10*c* is detachably attached to the special presser group which is operated only at a left basic line of a presser foot 11 of the straight stitching along the fabric edge. The shank 10*b* is detachably attached to the ordinary presser group for the zigzag stitch, but is not attached to a presser bottom plate of the special presser group, so that erroneous use of the presser may be avoided.

The operation of the device of the first embodiment will be explained below.

The fabric edge is stitched with, for example, the presser foot 11 for straight stitching along the fabric edge among the special presser group, by attaching the presser foot 11 to the shank 10*c*, selecting the straight stitching along the left basic line, and performing stitching on a needle dropping point L. In this case, a left feed dog 12 and a center feed dog 13 come near the needle dropping point L and are actuated effectively, so that the feed is preferable to a fabric 14, and since the position of the shank 10*c* and the position of the needle dropping point L are near the needle amplitude direction, the presser foot 11 is not included as conventionally, and there are no problems of escaping the fabric, or disordering of stitches.

Figure 6:
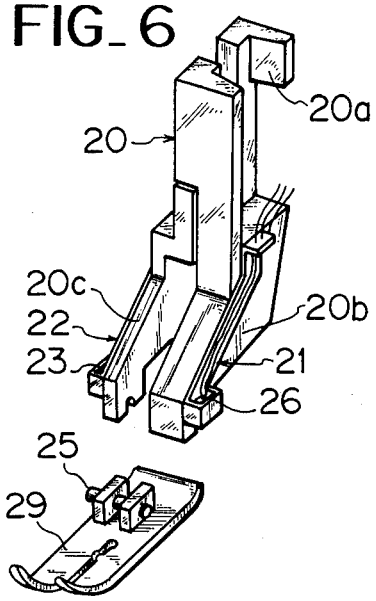
FIG. 6 is an exploded perspective view of a presser holder and a presser foot.
Figure 7:
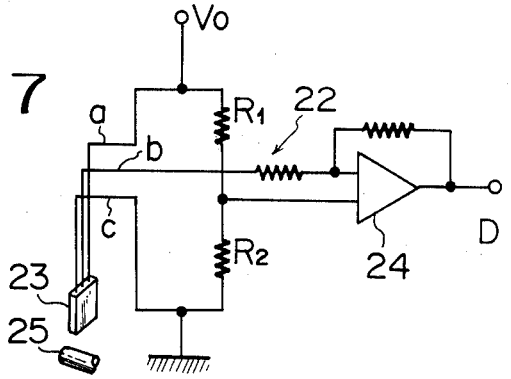
FIG. 7 is an output circuit of a signal from a presser group.

Further, the invention will be explained with reference to the second embodiment. In FIG. 6, a presser holder 20 is, as in the first embodiment, formed with an attaching part 20*a*, a shank 20*b* for an ordinary presser foot, and a shank 20*c* for a special presser foot, the shanks 20*b* and 20*c* being provided with signal generators 21 and 22, respectively.

The signal generators 21 and 22 have both the same circuit structure, and an explanation will be made herein below. Each signal generator for example generator 22 is composed of a sensitive magmetic element 23, resistances $R_1$ and $R_2$ making a bridge circuit together with the element 23, and an amplifier circuit 24. If a magnetic permeable substance 25, for example, steel approaches the element 23, the resistances between terminals a and b and between terminals b and c are varied, and the signal from the presser group is output from a terminal D via the amplitude circuit 24. Reference numeral 26 denotes a sensitive magnetic element of the signal generator 21. In this embodiment, the signal of the ordinary presser group is issued from the signal generator 21, and the signal of the special presser group is issued from the signal generator 22.

Figure 8:
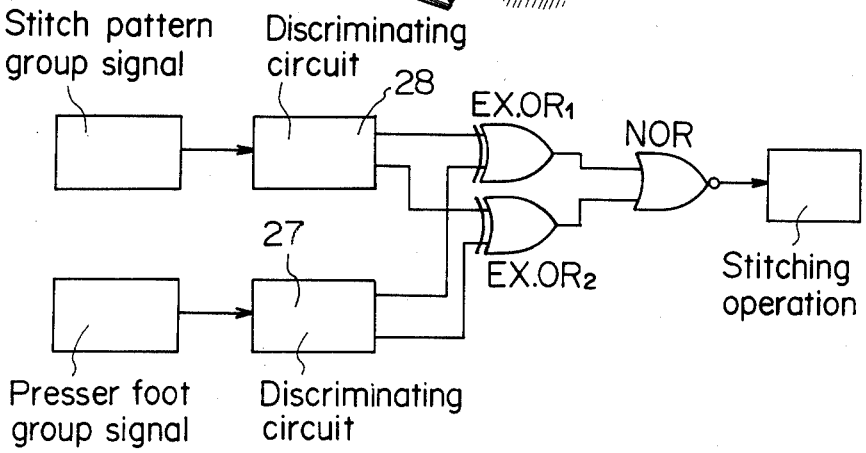
FIG. 8 is a block diagram of a circuit showing an example of discriminating control by the signal from the presser group.

In FIG. 8, a discriminating circuit 27 operates discrimination on the presser group by the signal from the presser foot. If the presser group under discrimination is the special presser group such as the straight stitching along the fabric edge, "1" signal is output only to a side of $EX.OR_1$ of an exclusive circuit OR. If it is the presser group of the ordinary stitch, "1" signal is output only to a side of $EX.OR_2$ of an exclusive circuit OR.

A discriminating circuit 28 operates the stitch group and the signal of the stitch group is an output signal in association with pattern selecting operation of the sewing machine. If the stitch group under discrimination is the special stitch group such as the straight stitching along the fabric edge (straight stitching along the left basic line), "1" signal is output only to the side of $EX.OR_1$ of the exclusive OR circuit. If it is the ordinary stitching group, "1" signal is output only to the side of $EX.OR_2$ of the exclusive OR circuit.

The outputs from $EX.OR_1$ and $EX.OR_2$ of the exclusive circuits are issued to NOR, circuit NOR respectively. If the output of said circuit is "1", the sewing machine can be rotated by stepping the controller, and if it is "0" the sewing machine cannot be driven.

Now the operation of the device of the second embodiment will be explained. For performing the special stitching, when the presser foot 29 for the straight stitching along the fabric edge is attached to the shank 20*c* of the presser holder 20, the signal is output from the signal generator 22, and "1" signal is output from the discriminating circuit 27 to $EX.OR_1$ of the exclusive OR circuit. When the straight stitching along the left basic line is selected, "1" signal is output only to the side of $EX.OR_1$ of the exclusive OR circuit by the discriminating circuit 28, and therefore the inputs to NOR circuit NOR are "0" respectively, and the outputs are "1", so that the sewing machine is driven by stepping the controller.

If the pattern of the ordinary stitch group is selected by the pattern selecting means under the condition that the presser foot 29 is attached, "1" is output only to the side of $EX.OR_2$ of the exclusive circuit from the discriminating circuit 28, and therefore, the inputs of NOR circuit NOR are "1" respectively, and since the output is "0", the sewing machine cannot be driven, so that safety would be provided when the presser group and the stitch group are not met by the erroneous operation.

As mentioned above, according to the invention, the devised shank is provided to the presser foot of the sewing machine in addition to the ordinary shank, such that the special presser group for straight stitching along the fabric edge is attached to the devised shank only, in which the presser foot is such a type that the presser bottom plate is detachably attached to the presser holder which in turn is attached to a presser bar. The ordinary shank is provided to the presser holder for the ordinary presser group as zigzag stitching, and said devised shank is different from the ordinary shank in attaching width, whereby erroneous use of the presser foot is avoided and an applied range of stitching may be enlarged. Signal generating parts are provided to the presser holder, which each issue a signal in response to the presser holder when the presser foot is attached, said signal is compared and discriminated with a signal which is issued in response to a pattern group belonging to patterns selected by a pattern selecting means so that the sewing machine is not driven when the presser group and the pattern group are not met, to avoid erroneous operation.

We claim:

1. A fabric presser device for a sewing machine having a presser bar and a set of fabric feed dogs for feeding a fabric to be sewn in forward and backward directions, the fabric presser device comprising holder means detachably attached to said presser bar, said holder means including at least a pair of shanks of different width and arranged side by side above the set of said fabric feed dogs in a direction transverse of the fabric feeding direction, and a plurality of presser feet for pressing the fabric being sewn against said feed dogs, each presser foot being specific to a selected one of said shanks and detachably attachable thereto so as to define an effective pressure point of a selected shank on the fabric being sewn relative to said set of fabric feed dogs, whereby a pressure point of each shank on the fabric being sewn relative to the set of fabric feed dogs is different from that of another shank, and each shank can be selected to define a position of a respective presser foot relative to a needle dropping point so as to prevent sliping of the fabric being sewn from said respective presser foot and means for indicating if the said each presser foot is attached to the said specific selected shank and for indicating if a said each presser foot is improperly attached to a nonselected shank.

2. The fabric presser device as defined in claim 1, wherein said means for indicating further comprises means for producing different pattern signals including a pattern signal which is specific to said selected presser foot; wherein said selected one of said shank and said selected respective presser foot have means for producing a presser foot type signal, said device further comprising means for comparing said pattern signals and said presser foot type signal to produce a signal to make said sewing machine operative or inoperative.

3. The fabric presser device as defined in claim 2, wherein said means for producing said selected presser foot type signal includes magnet means provided on said selected presser foot and magnet-sensitive means provided on said selected one of said shanks.

* * * * *